US009123306B2

(12) United States Patent
Park

(10) Patent No.: US 9,123,306 B2
(45) Date of Patent: Sep. 1, 2015

(54) GAMMA VOLTAGE GENERATING DEVICE, LCD DEVICE, AND METHOD OF DRIVING THE LCD DEVICE

(75) Inventor: Jin-O Park, Yongin (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 460 days.

(21) Appl. No.: 13/137,749

(22) Filed: Sep. 9, 2011

(65) Prior Publication Data

US 2012/0182280 A1 Jul. 19, 2012

(30) Foreign Application Priority Data

Jan. 14, 2011 (KR) ..... 10-2011-0004089

(51) Int. Cl.
*G09G 5/00* (2006.01)
*G09G 3/36* (2006.01)

(52) U.S. Cl.
CPC ..... *G09G 3/3648* (2013.01); *G09G 2320/0257* (2013.01); *G09G 2320/0673* (2013.01)

(58) Field of Classification Search
CPC ..... G09G 2320/0257; G09G 2320/0673; G09G 3/3648
USPC ..... 345/89, 96, 98, 100, 589, 690, 211
See application file for complete search history.

(56) References Cited

U.S. PATENT DOCUMENTS

2002/0051109 A1 5/2002 Nakanishi et al.
2003/0090451 A1* 5/2003 Ahn ..... 345/96
2006/0152462 A1* 7/2006 Furihata et al. ..... 345/98
2007/0001964 A1* 1/2007 Lee et al. ..... 345/96
2007/0046600 A1* 3/2007 Sun ..... 345/89
2007/0229442 A1* 10/2007 Yi ..... 345/100
2009/0160879 A1* 6/2009 Tu et al. ..... 345/690
2009/0179845 A1 7/2009 Song et al.
2010/0277494 A1* 11/2010 Cho et al. ..... 345/589

FOREIGN PATENT DOCUMENTS

KR 10-2002-0034857 A 5/2002
KR 10-2002-0091354 A 12/2002
KR 10-2007-0098365 A 10/2007
KR 10-2008-0061321 A 7/2008
KR 10-2009-0072877 A 7/2009
KR 10-2009-0131711 A 12/2009
WO WO 2009/154355 A2 12/2009

* cited by examiner

*Primary Examiner* — Quan-Zhen Wang
*Assistant Examiner* — Tony Davis
(74) *Attorney, Agent, or Firm* — Lee & Morse, P.C.

(57) ABSTRACT

A liquid crystal display (LCD) device and a method of driving the LCD device. The LCD device includes a display panel having a plurality of pixels, a gamma voltage generating unit, and a source driver. The pixels are defined by a plurality of data lines and a plurality of gate lines that cross each other. The gamma voltage generating unit generates a first gamma voltage at a higher voltage level than that of a target gamma voltage determined in advance based on a particular gradation and a second gamma voltage at a lower voltage level than that of the target gamma voltage. The source driver converts digital image data to analog image data by using the first gamma voltage and the second gamma voltage and displays the analog image data on the display panel using a dot inversion method.

12 Claims, 8 Drawing Sheets

FIG. 5A

| | | | |
|---|---|---|---|
| P+ | N− | P+ | N− |
| N− | P+ | N− | P+ |
| P+ | N− | P+ | N− |
| N− | P+ | N− | P+ |

(n)TH FRAME

FIG. 5B

| | | | |
|---|---|---|---|
| N+ | P− | N+ | P− |
| P− | N+ | P− | N+ |
| N+ | P− | N+ | P− |
| P− | N+ | P− | N+ |

(n+1)TH FRAME

FIG. 5C

| | | | |
|---|---|---|---|
| P− | N+ | P− | N+ |
| N+ | P− | N+ | P− |
| P− | N+ | P− | N+ |
| N+ | P− | N+ | P− |

(n+2)TH FRAME

FIG. 5D

| | | | |
|---|---|---|---|
| N− | P+ | N− | P+ |
| P+ | N− | P+ | N− |
| N− | P+ | N− | P+ |
| P+ | N− | P+ | N− |

(n+3)TH FRAME

GAMMA VOLTAGE GENERATING DEVICE, LCD DEVICE, AND METHOD OF DRIVING THE LCD DEVICE

CROSS-REFERENCE TO RELATED PATENT APPLICATION

This application claims the benefit of Korean Patent Application No. 10-2011-0004089, filed on Jan. 14, 2011, in the Korean Intellectual Property Office, the disclosure of which is incorporated herein in its entirety by reference.

BACKGROUND

1. Field

Embodiments relate to a liquid crystal display (LCD) device and a method of driving the LCD device, and more particularly, to a LCD device with reduced afterimage and a method of driving the LCD device.

2. Description of the Related Art

Liquid crystal display (LCD) devices are widely used as display devices of laptop computers or mobile televisions due to their properties, including lightweight, small thickness, and low-power consumption.

A LCD device is formed by attaching a thin-film transistor TFT substrate, on which a TFT array is formed, and a color filter substrate, on which a color filter array is formed, to each other via a liquid crystal layer. The TFT substrate and the color filter substrate are attached to each other, e.g., with a sealant along borders of the TFT substrate. Alignment films are formed on surfaces of the TFT substrate and the color filter substrate facing each other and are rubbed so that liquid crystals of the liquid crystal layer are aligned in a uniform direction.

A LCD device displays data to be displayed by applying a voltage to liquid crystals by using dielectric anisotropy and refractive index anisotropy of the liquid crystals arranged between a TFT substrate and a color filter substrate. When the same image is displayed for a long time, even if the image is changed to another image, image quality is deteriorated due to an afterimage phenomenon by which the pattern of the previous image remains. An afterimage is formed due to a residual DC voltage formed in the liquid crystal layer.

FIGS. 1A and 1B illustrate schematic diagrams for describing the afterimage phenomenon of a liquid crystal panel. Referring to FIGS. 1A and 1B, when a DC voltage is applied to a liquid crystal layer adjacent to an alignment film, impurities in the liquid crystal layer are ionized. Here, positive ion impurities accumulate on an alignment film with negative polarity, whereas negative ion impurities accumulate on an alignment film with positive polarity. With the lapse of time, the ion impurities are attached to the alignment films, and thus, liquid crystal molecules acquire DC voltages due to the ion impurities attached to the alignment film. The DC voltages of the liquid crystal molecules are referred to as the residual DC voltages. The residual DC voltage changes alignment direction of the liquid crystal molecule by changing the pre-tilt angle, which is an optical parameter of the liquid crystal molecule, and thus, the liquid crystal molecules may become less sensitive when signal voltages applied from outside are changed. Therefore, if the same image is displayed for a long time, the pattern of the image remains due to accumulated charges even if the image is changed to another image.

SUMMARY

One or more embodiments provide a gamma voltage generating method and a liquid crystal display (LCD) device for preventing voltages applied to liquid crystals from being changed to different voltage levels other than desired voltage levels and causing defects of image quality, such as an afterimage.

One or more embodiments may provide a liquid crystal display (LCD) device including a display panel having a plurality of pixels defined by a plurality of data lines and a plurality of gate lines that cross each other; a gamma voltage generating unit, which generates a first gamma voltage at a higher voltage level than that of a target gamma voltage determined in advance based on a particular gradation and a second gamma voltage at a lower voltage level than that of the target gamma voltage; and a source driver, which converts digital image data to analog image data by using the first gamma voltage and the second gamma voltage and displays the analog image data on the display panel using a dot inversion method.

The gamma voltage generating unit may include a first gamma voltage generating unit, which generates a first positive gamma voltage at a higher voltage level than that of the target gamma voltage and a second negative gamma voltage at a lower voltage level than that of the target gamma voltage; and a second gamma voltage generating unit, which generates a second positive gamma voltage at a lower voltage level than that of the target gamma voltage and a first negative gamma voltage at a higher voltage level than that of the target gamma voltage.

The LCD device may further include a timing controller, which controls outputs of the gamma voltage generating unit and the source driver, wherein the source driver may select the first gamma voltage generating unit or the second gamma voltage generating unit according to a selecting signal received from the timing controller.

The LCD device may further include a timing controller, which controls outputs of the gamma voltage generating unit and the source driver, wherein the gamma voltage generating unit may output a gamma voltage from the first gamma voltage generating unit or the second gamma voltage generating unit to the source driver in response to a selecting signal received from the timing controller.

The gamma voltage generating unit may alternately output the first positive gamma voltage and the second negative gamma voltage in the $n^{th}$ frame, alternately output the first negative gamma voltage and the second positive gamma voltage in the $n+1^{th}$ frame, such that polarities of the gamma voltages output in the $n+1^{th}$ frame are opposite to those of the gamma voltages output in the $n^{th}$ frame, alternately outputs the second positive gamma voltage and the first negative gamma voltage in the $n+2^{th}$ frame, such that polarities of the gamma voltages output in the $n+2^{th}$ frame are opposite to those of the gamma voltages output in the $n+1^{th}$ frame, and alternately outputs the second negative gamma voltage and the first positive gamma voltage in the $n+3^{th}$ frame, such that polarities of the gamma voltages output in the $n+3^{th}$ frame are opposite to those of the gamma voltages output in the $n+2^{th}$ frame.

Voltage levels of the first gamma voltage and the second gamma voltage may differ according to gradations of input image data.

The source driver may include a digital-to-analog converter (DAC) which selectively receives the first gamma voltage and the second gamma voltage and generates the analog image data by using the first gamma voltage and the second gamma voltage.

The source driver may include a shift register configured to generate shift pulse signals based on source start pulse signals and a clock signal, a first latch configured to sample and hold the digital image data in synchronization with the clock signal and simultaneously output the digital image data, a second latch configured to sample and hold the digital image data from the first latch in synchronization with a latch signal, a digital-to-analog converter configured to convert the digital image data from the second latch to the analog image data based on the first gamma voltage and the second gamma voltage, and an output buffer configured to buffer the analog image data output from the digital-to-analog converter to the data lines.

One or more embodiments may provide a method of driving a liquid crystal display (LCD) device, the method including setting a target gamma voltage determined in advance according to a particular gradation; alternately outputting a first gamma voltage at a higher voltage level than that of the target gamma voltage and a second gamma voltage at a lower voltage level than that of the target gamma voltage; converting digital image data to analog image data by using the first gamma voltage and the second gamma voltage; and displaying the analog image data on the display panel using a dot inversion method.

The first gamma voltage may include a first positive gamma voltage and a second negative gamma voltage, the second gamma voltage may include a second positive gamma voltage and a first negative gamma voltage.

Alternately outputting the gamma voltages may include alternately outputting the first positive gamma voltage and the second negative gamma voltage in the $n^{th}$ frame, alternately outputting the first negative gamma voltage and the second positive gamma voltage in the $n+1^{th}$ frame, such that polarities of the gamma voltages output in the $n+2^{th}$ frame are opposite to those of the gamma voltages output in the $n^{th}$ frame, alternately outputting the second positive gamma voltage and the first negative gamma voltage in the $n+2^{th}$ frame, such that polarities of the gamma voltages output in the $n+2^{th}$ frame are opposite to those of the gamma voltages output in the $n+1^{th}$ frame, and alternately outputting the second negative gamma voltage and the first positive gamma voltage in the $n+3^{th}$ frame, such that polarities of the gamma voltages output in the $n+3^{th}$ frame are opposite to those of the gamma voltages output in the $n+2^{th}$ frame.

BRIEF DESCRIPTION OF THE DRAWINGS

Features will become more apparent by describing in detail exemplary embodiments thereof with reference to the attached drawings, in which:

FIGS. 5A through 5D illustrate schematic diagrams of polarities of data voltages supplied to a liquid crystal panel according to an exemplary embodiment;

DETAILED DESCRIPTION

Figure 1A:
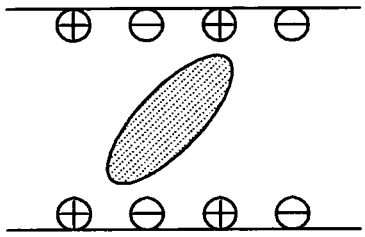
FIGS. 1A and 1B illustrate a schematic diagram for describing the afterimage phenomenon of a liquid crystal panel.
Figure 1B:
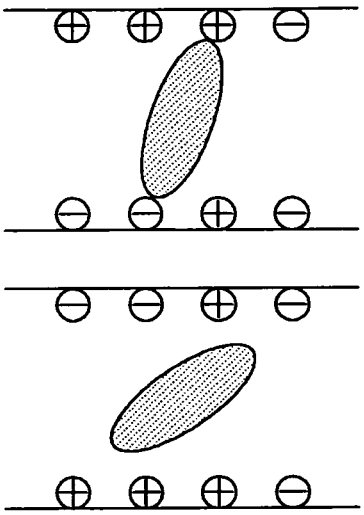

Hereinafter, exemplary embodiments of the present invention will be described with reference to the attached drawings. Like reference numerals denote like elements throughout the specification. In the description, certain detailed explanations of related art may not be explicitly described when it is deemed that the description thereof may unnecessarily obscure more pertinent features of embodiments.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Figure 2:
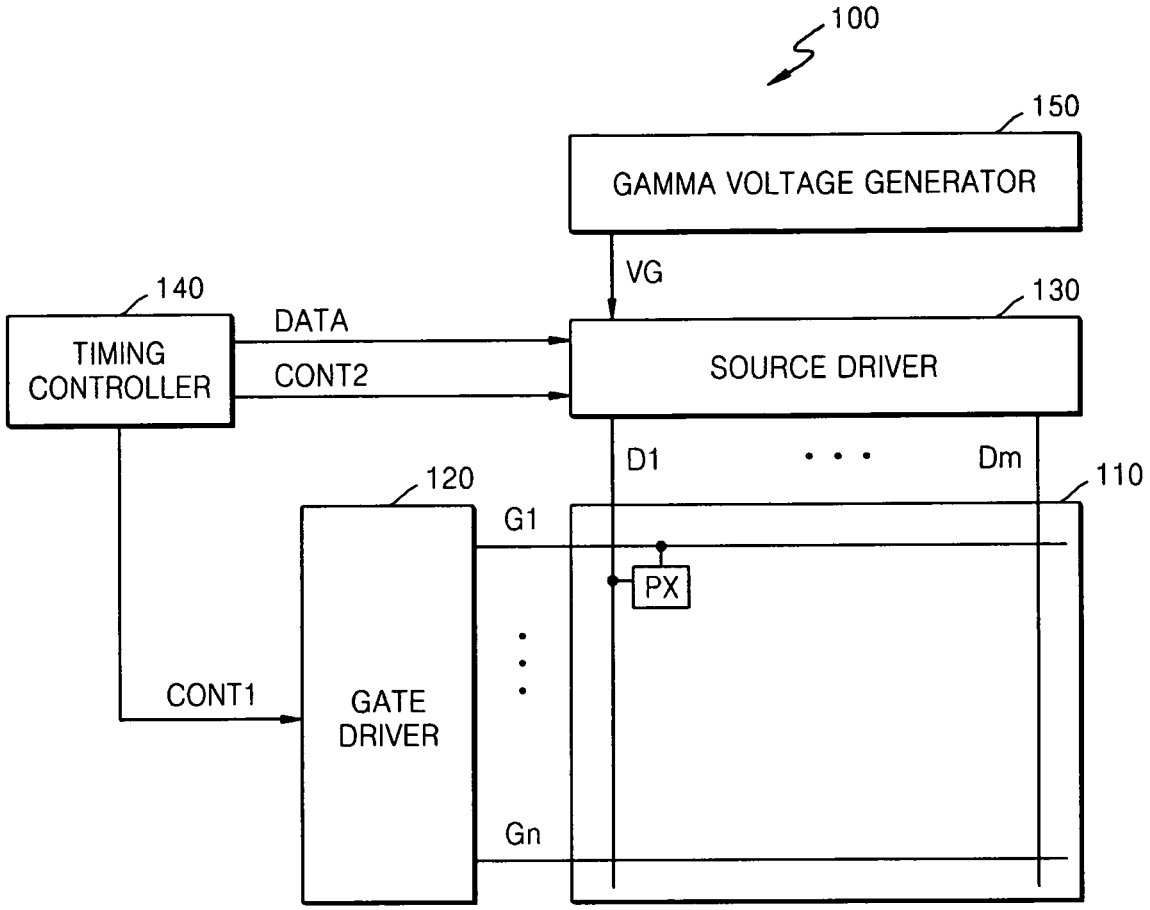
FIG. 2 illustrates a block diagram of an exemplary embodiment of a liquid crystal display (LCD) device.
Figure 3:
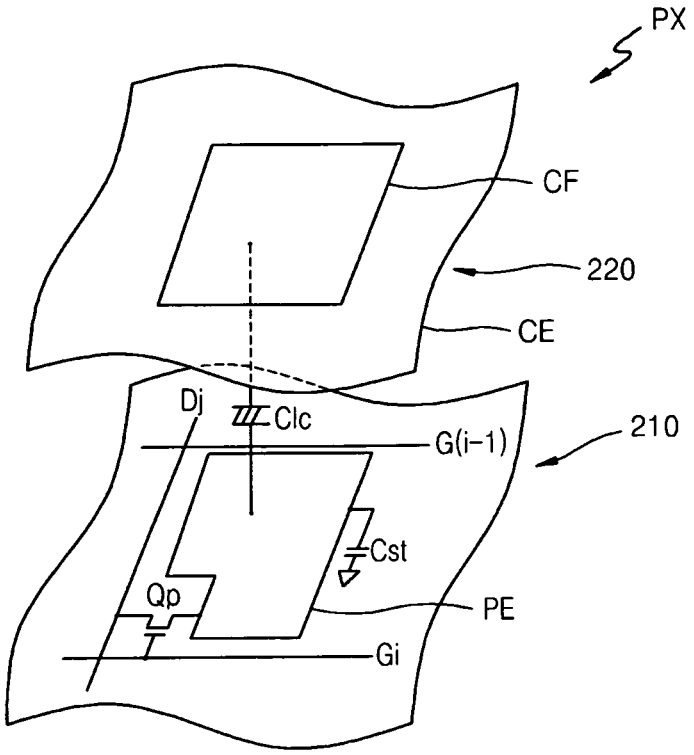
FIG. 3 illustrates a schematic diagram of an exemplary structure of a pixel.

FIG. 2 illustrates a block diagram of an exemplary embodiment of a liquid crystal display (LCD) device 100. FIG. 3 illustrates a schematic diagram of an exemplary structure of a pixel PX.

Referring to FIG. 2, the LCD device 100 may include a liquid crystal panel 110, a gate driver 120, a source driver 130, a timing controller 140, and a gamma voltage generating unit 150.

The LCD device 100 may drive the liquid crystal panel 110 by supplying gamma voltages VG to the source driver 130 by using the gamma voltage generating unit 150, applying data voltages to data lines D1 through Dm of the liquid crystal panel 110 by using the source driver 130, and applying gate voltages to gate lines G1 through Gn of the liquid crystal panel 110 by using the gate driver 120. Furthermore, the LCD device 100 may control the gate driver 120 and the source driver 130 by supplying a gate control signal CONT1 and a data control signal CONT2 to the gate driver 120 and the source driver 130, respectively, by using the timing controller 140.

The liquid crystal panel 110 may include the gate lines G1 through Gn, the data lines D1 through Dm, and the pixels PX. The gate lines G1 through Gn may be arranged in rows to be uniformly apart from each other, and each of the gate lines G1 through Gn transmit a gate voltage. The data lines D1 through Dm may be arranged in columns to be uniformly apart from each other, and each of the data lines D1 through Dm may transmit a data voltage. The gate lines G1 through Gn and the data lines D1 through Dm may be arranged in a matrix form, and pixels PX are respectively formed near points where the gate lines G1 through Gn and the data lines D1 through Dm cross each other.

The pixels PX of FIG. 2 will be described with reference to FIG. 3. The liquid crystal panel 110 may be formed by arranging a liquid crystal layer (not shown) between a first substrate 210 and a second substrate 220. The gate lines G1 through Gn, the data lines D1 through Dm, pixel switching devices Qp, and pixel electrodes PE may be formed on the first substrate 210. Color filters CF and common electrodes CE may be formed on the second substrate 220. Embodiments are not limited to the exemplary structure of FIGS. 2 and 3. For example, in one or more embodiments, the color filter CF may be arranged on or below the pixel electrode PE of the first substrate 210.

In one or more embodiments, the pixel PX may include the pixel switching device Qp, a storage capacitor Cst and a liquid crystal capacitor Clc. The pixel PX may be connected to an $i^{th}$ gate line Gi (i is a natural number between 1 and n) and a $j^{th}$ data line Dj (j is a natural number between 1 and m). The pixel switching device Qp may include a gate electrode connected to the gate line Gi, a first electrode connected to the data line Dj, and a second electrode connected to the pixel electrode PE. The storage capacitor Cst may be connected to the second electrode of the pixel switching device Qp via the pixel electrode PE.

The liquid crystal capacitor Clc may correspond to the pixel electrode PE of the first substrate 210 and the common electrode CE of the second substrate 220 and the liquid crystal layer as a dielectric substance between the pixel electrode PE and the common electrode CE. A common voltage may be applied to the common electrode CE. Light transmittance of the liquid crystal layer may be adjusted according to a voltage applied to the pixel electrode PE, and thus, brightness of each of the pixels PX may be adjusted. The pixel electrode PE may be connected to the data line Dj via the pixel switching device Qp. When the gate electrode of the pixel switching device Qp is connected to the gate line Gi and a gate ON voltage is applied to the gate line Gi, the pixel switching device Qp is turned on and applies a data voltage transmitted via the data line Dj to the pixel electrode PE.

The storage capacitor Cst is formed by overlapping the pixel electrode PE and a separate signal line (not shown) formed on the first substrate 210 in parallel to the gate line Gi, e.g., a storage line, with an insulation body therebetween. A common voltage or a predetermined voltage for the storage capacitor Cst may be applied to the separate signal line.

The pixel switching device Qp may be a thin-film transistor (TFT) formed of amorphous silicon.

Referring back to FIG. 2, the gate driver 120 may sequentially drive the gate lines G1 through Gn (n is a natural number) in response to the gate control signal CONT1. The gate driver 120 may generate and sequentially supply gate voltages, which are combinations of active level gate ON voltages and inactive level gate OFF voltages, to the liquid crystal panel 110 via the gate lines G1 through Gn.

The source driver 130 may generate data voltages corresponding to gradations of input image data DATA by using the gamma voltages VG in response to the data control signal CONT2 and may output the data voltages to the liquid crystal panel 110 via the data lines D1 through Dm (m is a natural number).

The timing controller 140 may receive the input image data DATA and an input control signal for controlling display of the input image data DATAg from an external graphic controller (not shown). Examples of the input control signal include a horizontal synchronization signal Hsync, a vertical synchronization signal Vsync, and a main clock MCLK. The timing controller 140 may transmit the input image data DATA to the source driver 130 and may generate and transmit the gate control signal CONT1 and the data control signal CONT2 to the gate driver 120 and the source driver 130, respectively. The gate control signal CONT1 may include a scan initiating signal, which instructs scanning initiation, and clock signals. The data control signal CONT2 may include a horizontal synchronization initiating signal, which instructs initiation of transmitting input image data with respect to the pixels PX in a single row, and a clock signal.

The gamma voltage generating unit 150 may generate gamma voltages VG and may output the gamma voltages VG to the source driver 130. The gamma voltages VG include positive gamma voltages and negative gamma voltages distributed between a high potential power voltage VDD and a low potential power voltage VSS. The gamma voltage generating unit 150 may output different gamma voltages according to gradations of data for each of the pixels and each of the frames under the control of the timing controller 140. For example, the gamma voltage generating unit 150 may generate a first gamma voltage at a higher voltage level than that of a target gamma voltage and a second gamma voltage at a lower voltage level than that of the target gamma voltage based on a particular gradation. The first gamma voltage includes a first positive gamma voltage and a first negative gamma voltage, whereas the second gamma voltage may include a second positive gamma voltage and a second negative gamma voltage.

The source driver 130 may output a data voltage generated by using the first gamma voltage or the second gamma voltage to the liquid crystal panel 110 using a dot inversion method.

FIGS. 4A through 4D show gamma voltages set for each of the pixels and each of the frames according to an exemplary embodiment.

Referring to FIGS. 4A through 4D, a target gamma voltage is set based on a particular gradation according to transmittance-voltage characteristics of a liquid crystal panel. Furthermore, to prevent formation of an afterimage by the liquid crystal panel 110, a compensation voltage ΔV is added or subtracted to or from the target gamma voltage for each of the pixels, such that differential AC voltages are applied to liquid crystals and residual DC voltages are removed.

In other words, in one or more embodiments, the first gamma voltage at a higher voltage level than that of the target gamma voltages +VG and −VG and the second gamma voltage at a lower voltage level than that of the target gamma voltages +VG and −VG are generated, where the target gamma voltages +VG and −−VG may be set in advance based on a particular gradation.

The first gamma voltage may include a first positive gamma voltage +VG1 and a first negative gamma voltage −VG1. The second gamma voltage may include a second positive gamma voltage +VG2 and a second negative gamma voltage −VG2.

The first positive gamma voltage +VG1 is equal to a positive target voltage +VG plus the compensation voltage ΔV, and thus, the first positive gamma voltage +VG1 is at a higher voltage level than that of the positive target voltage +VG. The first negative gamma voltage −VG1 is equal to a negative target voltage −VG minus the compensation voltage ΔV, and thus, the first negative gamma voltage −VG1 is at a higher voltage level than that of the negative target voltage −VG. That is, the absolute value of first positive gamma voltage is higher than the positive target voltage, and the absolute value of the first negative gamma voltage is higher than the negative target voltage.

The second positive gamma voltage +VG2 is equal to a positive target voltage +VG minus the compensation voltage ΔV, and thus, the second positive gamma voltage +VG2 is at a lower voltage level than that of the positive target voltage +VG. The second negative gamma voltage −VG2 is equal to a negative target voltage −VG plus the compensation voltage ΔV, and thus, the second negative gamma voltage −VG2 is at a lower voltage level than that of the negative target voltage −VG. That is, the absolute value of second positive gamma voltage is lower than the positive target voltage, and the absolute value of the second negative gamma voltage is lower than the negative target voltage.

For example, in the case where a target gamma voltage is set to ±2.5V and the compensation voltage ΔV is set to 0.3V in 32 gradations (grayscale) considering 50% transmittance, the first gamma voltage (±2.8V) or the second gamma voltage ±2.2V) may be selected with respect to each of the pixels.

Here, the magnitude of the compensation voltage ΔV may be differently set according to gradations of image data. For example, in black or white gradation in which a difference between the positive voltage level and the negative voltage level of the image data is significant, the compensation voltage ΔV may be set to a relatively large magnitude. In the intermediate gradation between black and white gradation in which the difference between the positive voltage level and the negative voltage level of the image data is insignificant, the compensation voltage ΔV may be set to a relatively small magnitude.

Hereinafter, gamma voltages set with respect to pixels during a period from an $n^{th}$ frame to an $n+3^{th}$ frame will be described. Here, n is a natural number.

Figure 4A:
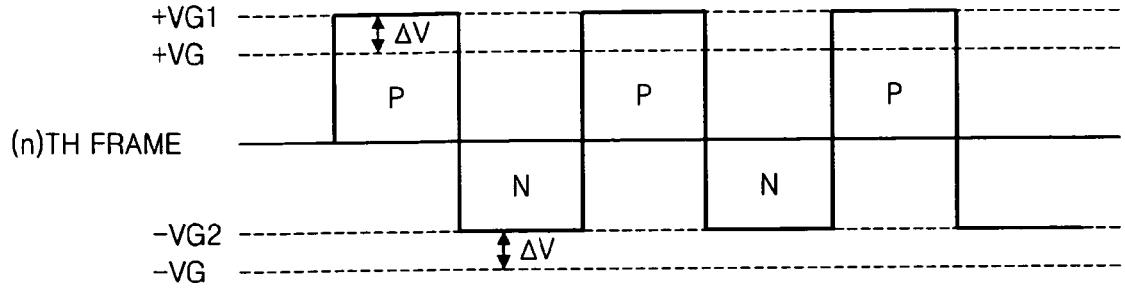
FIGS. 4A through 4D illustrate graphs of gamma voltages set for each of the pixels and each of the frames according to an exemplary embodiment.

Referring to FIG. 4A, the gamma voltage generating unit 150 may alternately output the first positive gamma voltage +VG1 and the second negative gamma voltage −VG2 in the $n^{th}$ frame.

Figure 4B:
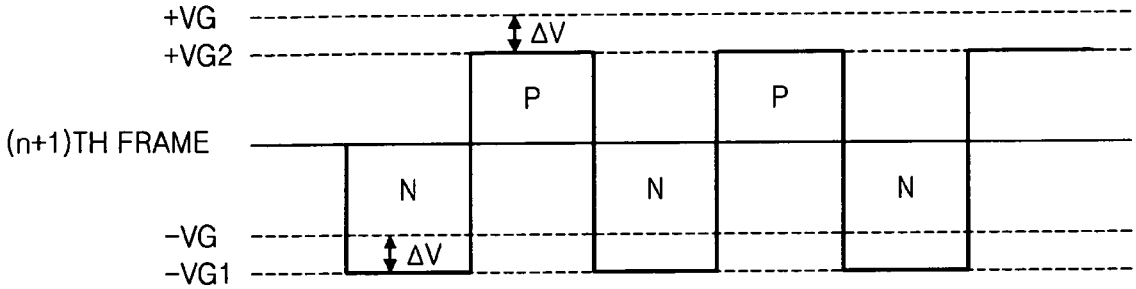

Referring to FIG. 4B, the gamma voltage generating unit 150 may alternately output gamma voltages of polarities opposite to those of the gamma voltages output in the $n^{th}$ frame. In other words, the gamma voltage generating unit 150 may alternately output the first negative gamma voltage −VG1 and the second positive gamma voltage +VG2 in the $n+1^{th}$ frame.

Figure 4C:
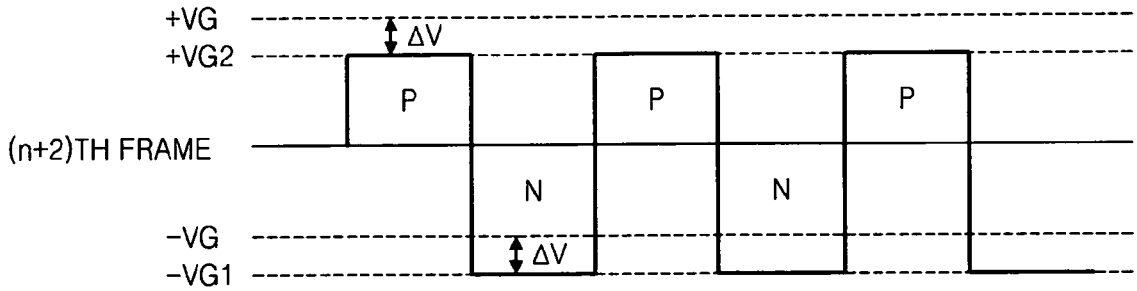

Referring to FIG. 4C, the gamma voltage generating unit 150 may alternately output gamma voltages of polarities opposite to those of the gamma voltages output in the $n+1^{th}$ frame. In other words, the gamma voltage generating unit 150 may alternately output the second positive gamma voltage +VG2 and the first negative gamma voltage −VG1 in the $n+2^{th}$ frame.

Figure 4D:
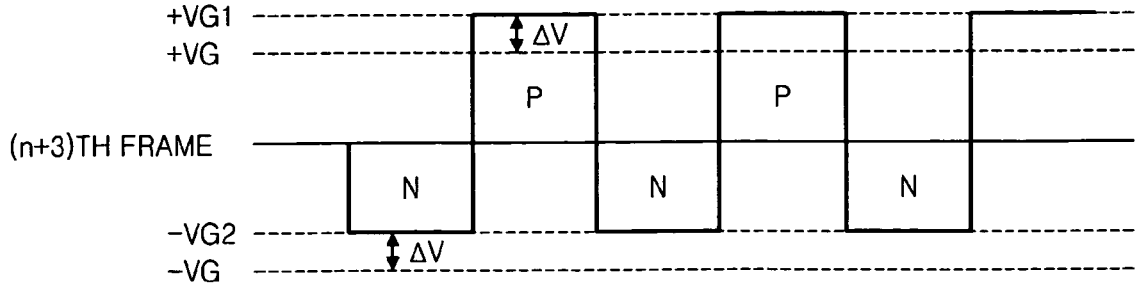

Referring to FIG. 4D, the gamma voltage generating unit 150 may alternately output gamma voltages of polarities opposite to those of the gamma voltages output in the $n+2^{th}$ frame. In other words, the gamma voltage generating unit 150 may alternately output the second negative gamma voltage −VG2 and the first positive gamma voltage +VG1 in the $n+3^{th}$ frame.

In frames thereafter, gamma voltages may be repetitively output in the order that the gamma voltages are output in the frames from the $n^{th}$ frame to the $n+3^{th}$ frame.

FIGS. 5A through 5D illustrate schematic diagrams of polarities of data voltages supplied to a liquid crystal panel according to an exemplary embodiment.

In FIGS. 5A through 5D, P+ corresponds to a positive data voltage output by using a gamma voltage at a higher voltage level than that of a target gamma voltage. N+ corresponds to a negative data voltage output by using a gamma voltage at a higher voltage level than that of a target gamma voltage. Furthermore, P− corresponds to a positive data voltage output by using a gamma voltage at a lower voltage level than that of the target gamma voltage. N− corresponds to a negative data voltage output by using a gamma voltage at a lower voltage level than that of the target gamma voltage.

One or more embodiments of a liquid crystal panel employing one or more features described herein may be driven using the dot inversion method. In the dot inversion method, a data voltage having a polarity opposite to all pixels horizontally and vertically nearby is supplied to each of the pixels, and the polarities of the data voltages are reversed for every frame.

In the case of displaying an image signal of an $n^{th}$ frame, the liquid crystal panel may supply data voltages to each of the pixels. The positive data voltage P+ output by using a gamma voltage at a higher voltage level than that of the target gamma voltage and the negative data voltage N− output by using a gamma voltage at a lower voltage level than that of the target gamma voltage may be alternately supplied to each of the pixels in a direction from the upper leftmost pixel to the lower rightmost pixel, as shown in FIG. 5A.

In the case of displaying an image signal of an $n+1^{th}$ frame, the liquid crystal panel may supply data voltages to each of the pixels. The negative data voltage N+ output by using a gamma voltage at a higher voltage level than that of the target gamma voltage and the positive data voltage P− output by using a gamma voltage at a lower voltage level than that of the target gamma voltage may be alternately supplied to each of the pixels in a direction from the upper leftmost pixel to the lower rightmost pixel in a manner opposite to that of the $n^{th}$ frame, as shown in FIG. 5B.

In the case of displaying an image signal of an $n+2^{th}$ frame, the liquid crystal panel may supply data voltages to each of the pixels. The negative data voltage N+ output by using a gamma voltage at a higher voltage level than that of the target gamma voltage and the positive data voltage P− output by using a gamma voltage at a lower voltage level than that of the target gamma voltage may be alternately supplied to each of the pixels in a direction from the upper leftmost pixel to the lower rightmost pixel in a manner opposite to that of the $n+1^{th}$ frame, as shown in FIG. 5C.

In the case of displaying an image signal of an $n+3^{th}$ frame, the liquid crystal panel may supply data voltages to each of the pixels. The positive data voltage P+ output by using a gamma voltage at a higher voltage level than that of the target gamma voltage and the negative data voltage N− output by using a gamma voltage at a lower voltage level than that of the target gamma voltage may be alternately supplied to each of the pixels in a direction from the upper leftmost pixel to lower rightmost pixel in a manner opposite to that of the $n+2^{th}$ frame, as shown in FIG. 5D.

As described above, in a pixel, polarities of gamma voltages at a first voltage level are reversed for a pair of successive frames (e.g., P+/N+), and polarities of gamma voltages on a second voltage level are reversed for a next pair of successive frames (e.g., P−/N−). Here, the first voltage level may be a voltage level higher than the target gamma voltage, whereas the second voltage level may be a voltage level lower than the target gamma voltage.

As gamma voltages are set for each of the frames and each of the pixels, as described in the above embodiment, a liquid crystal panel may reduce and/or prevent an afterimage phenomenon or a flickering phenomenon due to formation of residual DC voltages or DC offset voltages when the liquid crystal panel is driven at the same polarities for a long time.

Figure 6:
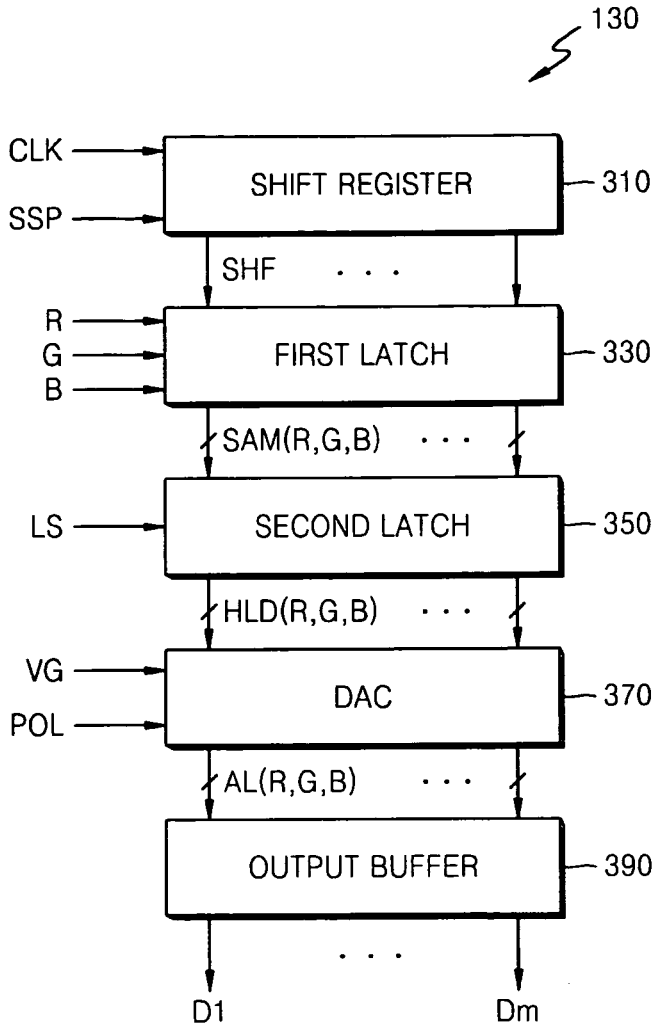
FIG. 6 illustrates a block diagram of an exemplary embodiment of an internal configuration of a source driver.

FIG. 6 illustrates a block diagram of an exemplary embodiment of an internal configuration of the source driver 130.

Referring to FIG. 6, the source driver 130 may include a shift register 310, a first latch 330, a second latch 350, a digital-to-analog converter (DAC) 370, and an output buffer 390.

The shift register 310 may include a plurality of flip-flops that respectively correspond to the data lines and are sequentially connected to each others in series. The shift register 310 may output shift pulse signals SHF by sequentially shifting source start pulses SSP to nearby flip-flops in synchronization with a clock signal CLK.

The first latch 330 may receive digital RGB data, sample and store the digital RGB data in synchronization with the shift pulse signals SHF output by each of the flip-flops of the shift register 310, and simultaneously output the digital RGB data.

The second latch 350 may hold the sampled RGB data input from the first latch 330 in synchronization with a latch signal LS.

The DAC 370 may convert the digital RGB data output from the second latch 350 to analog RGB data AL based on the gamma voltages VG supplied by the gamma voltage generating unit 150 and output the analog RGB data AL. The gamma voltages VG include the first gamma voltage at a higher voltage level than that of the target gamma voltage and the second gamma voltage at a lower voltage level than that of the target gamma voltage.

Furthermore, the DAC 370 may include a P decoder (not shown) to which a positive gamma voltage is supplied, an N decoder (not shown) to which a negative gamma voltage is supplied, and a multiplexer (not shown) which selects an output of the P decoder and an output of the N decoder in response to a polarity control signal POL.

The output buffer 390 may buffer the analog RGB data AL output from the DAC 370 and output the buffered analog RGB data AL to the data lines D1 through Dm. The output buffer 390 may include operational amplifiers OPC that respectively correspond to the data lines D1 through Dm, where each of the operational amplifiers OPC may perform impedance-conversion of the analog RGB data AL from the DAC 370 and output the impedance-converted analog RGB data AL to each of the data lines D1 through Dm.

Figure 7:
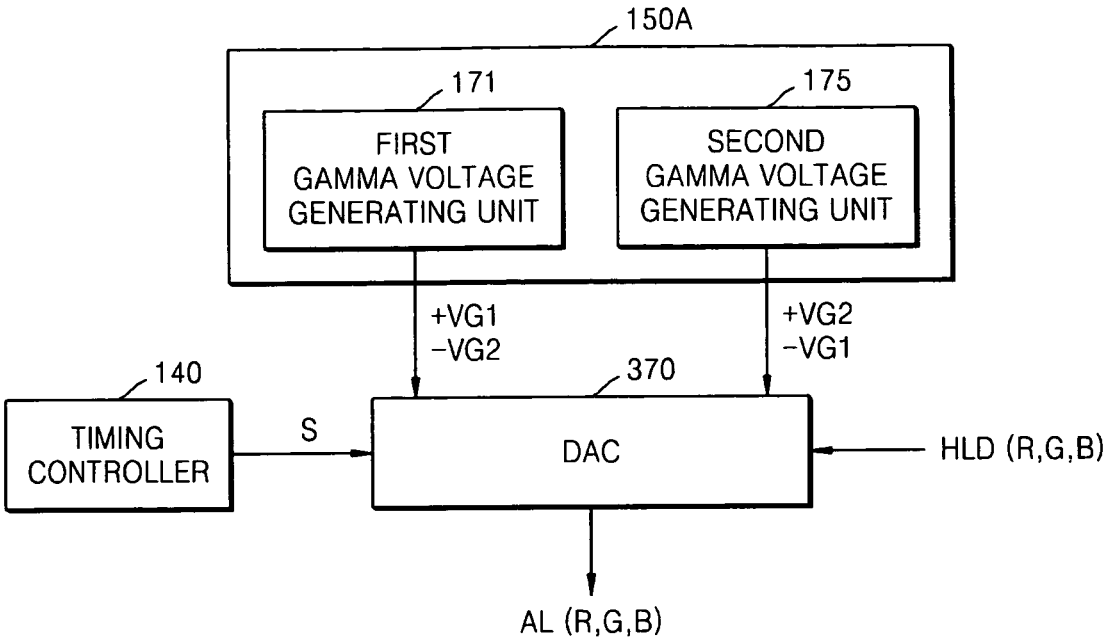
FIG. 7 illustrates a block diagram of an exemplary embodiment of a gamma voltage selecting method.

FIG. 7 illustrates a block diagram of an exemplary embodiment of a gamma voltage selecting method.

Referring to FIG. 7, the gamma voltage generating unit 150A may include a first gamma voltage generating unit 171 and a second gamma voltage generating unit 175.

The first gamma voltage generating unit 171 may generate gamma voltages via voltage distribution by using resistor strings between the high potential power voltage VDD and the low potential power voltage VSS. The first gamma voltage generating unit 171 may output the first positive gamma voltage +VG1 at a higher voltage level than that of the target gamma voltage and the second negative gamma voltage −VG2 at a lower voltage level than that of the target gamma voltage.

The second gamma voltage generating unit 175 may generate gamma voltages via voltage distribution by using resistor strings between the high potential power voltage VDD and the low potential power voltage VSS. The second gamma voltage generating unit 175 may output the second positive gamma voltage +VG2 at a lower voltage level than that of the target gamma voltage and the first negative gamma voltage −VG1 at a higher voltage level than that of the target gamma voltage.

The first gamma voltage generating unit 171 and the second gamma voltage generating unit 175 may be configured as individual integrated circuit chips or a signal integrated circuit chip.

Referring to FIGS. 6 and 7, the DAC 370 of the source driver 130 may receive digital RGB data HLD from the second latch 350. Next, the DAC 370 receives a gamma voltage selecting signal S from the timing controller 140. The DAC 370 selects the first gamma voltage generating unit 171 or the second gamma voltage generating unit 175 according to the gamma voltage selecting signal S at every frame. The DAC 370 may convert the digital RGB data to the analog RGB data AL based on a gamma voltage output by the selected first gamma voltage generating unit 171 or the selected second gamma voltage generating unit 175 and outputs the analog RGB data AL.

Figure 8:
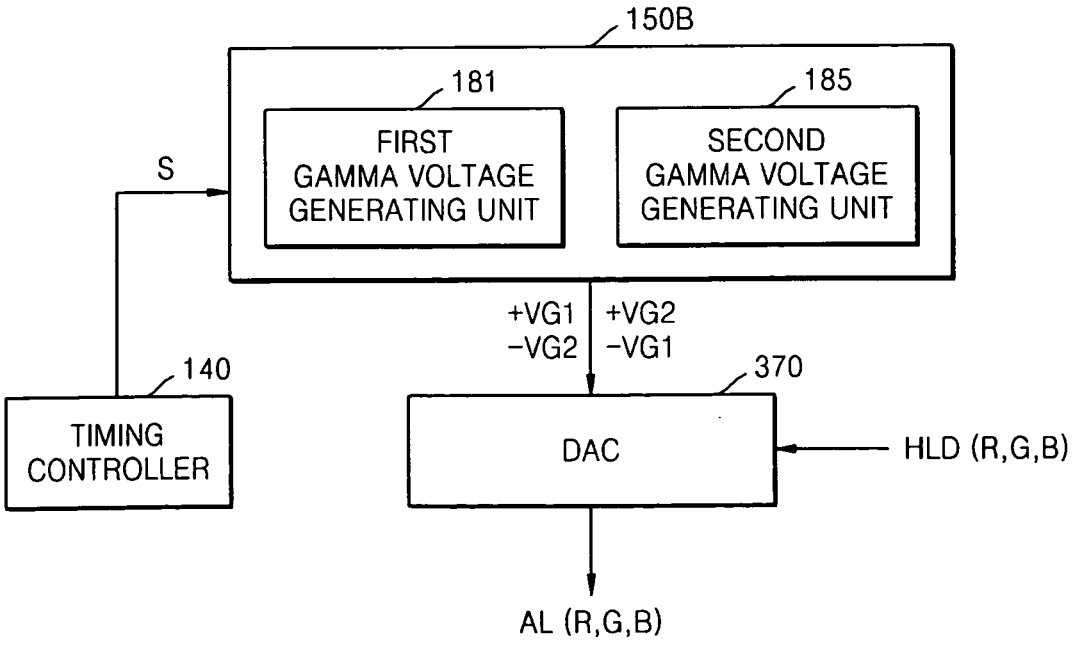
FIG. 8 illustrates a block diagram of an exemplary embodiment of a gamma voltage selecting method.

FIG. 8 illustrates a block diagram of an exemplary embodiment of a gamma voltage selecting method.

Referring to FIG. 8, the gamma voltage generating unit 150B may include a first gamma voltage generating unit 181 and a second gamma voltage generating unit 185.

The first gamma voltage generating unit 181 may generate gamma voltages via voltage distribution by using resistor strings between a high potential power voltage VDD and a low potential power voltage VSS. The first gamma voltage generating unit 181 may output the first positive gamma voltage +VG1 at a higher voltage level than that of the target gamma voltage and the second negative gamma voltage −VG2 at a lower voltage level than that of the target gamma voltage.

The second gamma voltage generating unit 185 may generate gamma voltages via voltage distribution by using resistor strings between the high potential power voltage VDD and the low potential power voltage VSS. The second gamma voltage generating unit 185 may output the second positive gamma voltage +VG2 at a lower voltage level than that of the target gamma voltage and the first negative gamma voltage −VG1 at a higher voltage level than that of the target gamma voltage.

The first gamma voltage generating unit 181 and the second gamma voltage generating unit 185 may be configured as individual integrated circuit chips or a signal integrated circuit chip.

The timing controller 140 may set a gamma voltage of a gradation corresponding to input image data. Furthermore, the timing controller 140 may output the gamma voltage selecting signal S to the first gamma voltage generating unit 181 or the second gamma voltage generating unit 185, which generates the set gamma voltage. The timing controller 140 may select the first gamma voltage generating unit 181 or the second gamma voltage generating unit 185 according to the gamma voltage selecting signal S using a 1-bit binary signal.

The gamma voltage generating unit 150B may receive the gamma voltage selecting signal S from the timing controller 140. When the gamma voltage selecting signal S is received during a current frame, the first gamma voltage generating unit 181 may alternately output the first positive gamma voltage +VG1 and the second negative gamma voltage −VG2. Furthermore, when the gamma voltage selecting signal S is received during the current frame, the second gamma voltage generating unit 185 may alternately output the second positive gamma voltage +VG2 and the first negative gamma voltage −VG1.

The DAC 370 of the source driver 130 may receive the digital RGB data HLD from the second latch 350. The DAC 370 may then convert the digital RGB data HLD to the analog RGB data AL based on a first gamma voltage or a second gamma voltage input from the gamma voltage generating unit 150B at every frame.

Figure 9:
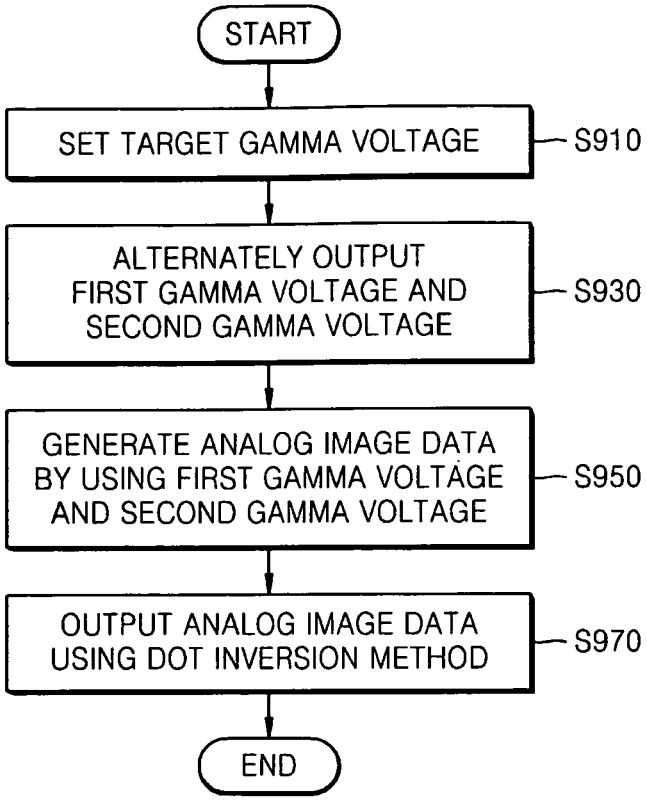
FIG. 9 illustrates a flowchart of an exemplary embodiment of a method of driving a LCD device.

FIG. 9 illustrates a flowchart of an exemplary embodiment of a method of driving a LCD device.

The LCD device may set target gamma voltages determined in advance based on a particular gradation (S910).

The LCD device may alternately output a first gamma voltage at a higher voltage level than that of the target gamma voltages and the second gamma voltage at a lower voltage level than that of the target gamma voltages (S930).

The first gamma voltage may include the first positive gamma voltage and the first negative gamma voltage. The second gamma voltage may include the second positive gamma voltage and the second negative gamma voltage. The compensation voltage ΔV, which is a voltage level difference between the target gamma voltage and the first gamma voltage or a voltage level difference between the target gamma voltage and the second gamma voltage, may be differently set according to gradations of input image data. In other words, voltages levels of the first positive gamma voltage, the first negative gamma voltage, the second positive gamma voltage, and the second negative gamma voltage may differ according to gradations of the input image data.

The LCD device may alternately output the first positive gamma voltage and the second negative gamma voltage in the $n^{th}$ frame. Next, the LCD device may alternately output gamma voltages of polarities opposite to those of the gamma voltages output in the $n^{th}$ frame. In other words, the LCD device may alternately output the first negative gamma voltage and the second positive gamma voltage in the $n+1^{th}$ frame. Next, the LCD device may alternately output gamma voltages of polarities opposite to those of the gamma voltages output in the $n+1^{th}$ frame. In other words, the LCD device may alternately output the second positive gamma voltage and the first negative gamma voltage in the $n+2^{th}$ frame. Next, the LCD device may alternately output gamma voltages of polarities opposite to those of the gamma voltages output in the $n+2^{th}$ frame. In other words, the LCD device may alternately output the second negative gamma voltage and the first positive gamma voltage in the $n+3^{th}$ frame.

The LCD device may convert digital image data to analog image data by using the first gamma voltage and the second gamma voltage (S950).

The LCD device may display the analog image data on a display panel using the dot inversion method (S970).

One or more embodiments of an LCD employing one or more features described herein may reduce and/or prevent an afterimage phenomenon or a flickering phenomenon due to formation of residual DC voltages (or DC offset voltages) when the liquid crystal panel is driven at the same polarities for a long time.

While aspects of the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A liquid crystal display (LCD) device, comprising:

a display panel including a plurality of pixels defined by a plurality of data lines and a plurality of gate lines that cross each other;

a gamma voltage generating unit including:

a first gamma voltage generating unit to generate a first positive gamma voltage at a higher voltage level than that of a positive target gamma voltage determined in advance based on a particular gradation and a second negative gamma voltage, wherein an absolute value of the second negative gamma voltage is smaller than that of a negative target gamma voltage; and a second gamma voltage generating unit to generate a second positive gamma voltage at a lower voltage level than that of the positive target gamma voltage and a first negative gamma voltage, wherein an absolute value of the first negative gamma voltage is greater than that of the negative target gamma voltage determined in advance based on the particular gradation;

a timing controller to control outputs of the gamma voltage generating unit and the source driver, wherein the gamma voltage generating unit outputs a gamma voltage from the first gamma voltage generating unit or the second gamma voltage generating unit to the source driver in response to a selecting signal received from the timing controller; and a source driver to convert the digital image data to analog image data using a first pair of the first positive gamma voltage and the second negative gamma voltage alternately in a first frame and using a second pair of the second positive gamma voltage and the first negative gamma voltage alternately in a second frame, and to display the analog image data on the display panel using a dot inversion method, wherein the gamma voltage generating unit is to alternately output the first positive gamma voltage and the second negative gamma voltage in an $n^{th}$ frame, the gamma voltage generating unit alternately outputs the first negative gamma voltage and the second positive gamma voltage in an $n+1^{th}$ frame, such that polarities of the gamma voltages output in the $n+1^{th}$ frame are opposite to those of the gamma voltages output in the $n^{th}$ frame, the gamma voltage generating unit alternately outputs the second positive gamma voltage and the first negative gamma voltage in an $n+2^{th}$ frame, such that polarities of the gamma voltages output in the $n+2^{th}$ frame are opposite to those of the gamma voltages output in the $n+1^{th}$ frame, and the gamma voltage generating unit alternately outputs the second negative gamma voltage and the first positive gamma voltage in an $n+3^{th}$ frame, such that polarities of the gamma voltages output in the $n+3^{th}$ frame are opposite to those of the gamma voltages output in the $n+2^{th}$ frame.

2. The LCD device of claim 1, wherein the source driver selects the first gamma voltage generating unit or the second gamma voltage generating unit according to the selecting signal received from the timing controller.

3. The LCD device of claim 1, wherein voltage levels of the first positive gamma voltage, the first negative gamma voltage, the second positive gamma voltage, and the second negative gamma voltage differ according to gradations of input image data.

4. The LCD device of claim 1, wherein the source driver comprises a digital-to-analog converter (DAC) to selectively receive the first positive gamma voltage, the first negative gamma voltage, the second positive gamma voltage, and the second negative gamma voltage and to generate the analog image data by using the first positive gamma voltage, the first negative gamma voltage, the second positive gamma voltage, and the second negative gamma voltage.

5. The LCD device of claim 1, wherein the source driver includes:

a shift register to generate shift pulse signals based on source start pulse signals and a clock signal;

a first latch to sample and hold the digital image data in synchronization with the clock signal and simultaneously output the digital image data;

a second latch to sample and hold the digital image data from the first latch in synchronization with a latch signal;

a digital-to-analog converter to convert the digital image data from the second latch to the analog image data based on the first positive gamma voltage, the first negative gamma voltage, the second positive gamma voltage, and the second negative gamma voltage; and an output buffer to buffer the analog image data output from the digital-to-analog converter to the data lines.

6. The liquid crystal display (LCD) device of claim 1, wherein the first positive target gamma voltage is determined by adding a compensation voltage determined in advance based on a particular gradation to the positive target gamma voltage, the second positive gamma voltage is determined by subtracting the compensation voltage from the positive target gamma voltage, the first negative gamma voltage is determined by subtracting the compensation voltage to the negative target gamma voltage, and the second negative gamma voltage is determined by adding the compensation voltage to the negative target gamma voltage.

7. A gamma voltage generating device, comprising:

a first gamma voltage generating unit to generate a first positive gamma voltage at a higher voltage level than that of a target positive gamma voltage and a second negative gamma voltage, wherein an absolute value of the second negative gamma voltage is smaller than that of a target negative gamma voltage; and a second gamma voltage generating unit to generate a second positive gamma voltage at a lower voltage level than that of the target positive gamma voltage and a first negative gamma voltage, wherein an absolute value of the first negative gamma voltage is greater at a higher voltage level than that of the target negative gamma voltage, wherein:

the gamma voltage generating device outputting a first pair of the first positive gamma voltage and the second negative gamma voltage alternately in a first frame and outputting a second pair of the second positive gamma voltage and the first negative gamma voltage alternately in a second frame, the outputs of the gamma voltages are selected based on a selecting signal received from a timing controller, and the outputs of the gamma voltages are selected under control of a source driver, the source driver to convert digital image data to analog image data using the first positive gamma voltage, the first negative gamma voltage, the second positive gamma voltage, and the second negative gamma voltage and to display the analog image data on the display panel using a dot inversion method, wherein the gamma voltage generating device alternately outputs the first positive gamma voltage and the second negative gamma voltage in an $n^{th}$ frame, the gamma voltage generating device alternately outputs the first negative gamma voltage and the second positive gamma voltage in an $n+1^{th}$ frame, such that polarities of the gamma voltages output in the $n+1^{th}$ frame are opposite to those of the gamma voltages output in the $n^{th}$ frame, the gamma voltage generating device alternately outputs the second positive gamma voltage and the first negative gamma voltage in an $n+2^{th}$ frame, such that polarities of the gamma voltages output in the $n+2^{th}$ frame are opposite to those of the gamma voltages output in the $n+1^{th}$ frame, and the gamma voltage generating device alternately outputs the second negative gamma voltage and the first positive gamma voltage in an $n+3^{th}$ frame, such that polarities of the gamma voltages output in the $n+3^{th}$ frame are opposite to those of the gamma voltages output in the $n+2^{th}$ frame.

8. The gamma voltage generating device of claim 7, wherein voltage levels of the first positive gamma voltage, the first negative gamma voltage, the second positive gamma voltage, and the second negative gamma voltage differ according to gradations of input image data.

9. The gamma voltage generating device of claim 7, wherein the first positive target gamma voltage is determined by adding a compensation voltage determined in advance based on a particular gradation to the positive target gamma voltage, the second positive gamma voltage is determined by subtracting the compensation voltage from the positive target gamma voltage, the first negative gamma voltage is determined by subtracting the compensation voltage to the negative target gamma voltage, and the second negative gamma voltage is determined by adding the compensation voltage to the negative target gamma voltage.

10. A method of driving a liquid crystal display (LCD) device, the method comprising:

setting a target positive gamma voltage and a target negative gamma voltage determined in advance according to a particular gradation;

outputting a first pair of a first positive gamma voltage at a higher voltage level than that of the target positive gamma voltage and a second negative gamma voltage alternately in a first frame, wherein an absolute value of the second negative gamma voltage is smaller than that of the target negative gamma voltage, and a second pair of a second positive gamma voltage at a lower voltage level than that of the target positive gamma voltage and a first negative gamma voltage alternately in a second frame, wherein an absolute value of the first negative gamma voltage is greater than that of the target negative gamma voltage;

converting digital image data to analog image data using the first positive gamma voltage, the first negative gamma voltage, the second positive gamma voltage, and the second negative gamma voltage; and displaying the analog image data on the display device using a dot inversion method, wherein outputting the first and second pairs of gamma voltages, includes:

alternately outputting the first positive gamma voltage and the second negative gamma voltage in an $n^{th}$ frame, alternately outputting the first negative gamma voltage and the second positive gamma voltage in an $n+1^{th}$ frame, such that polarities of the gamma voltages output in the $n+1^{th}$ frame are opposite to those of the gamma voltages output in the $n^{th}$ frame, alternately outputting the second positive gamma voltage and the first negative gamma voltage in an $n+2^{th}$ frame, such that polarities of the gamma voltages output in the $n+2^{th}$ frame are opposite to those of the gamma voltages output in the $n+1^{th}$ frame, and alternately outputting the second negative gamma voltage and the first positive gamma voltage in an $n+3^{th}$ frame, such that polarities of the gamma voltages output in the $n+3^{th}$ frame are opposite to those of the gamma voltages output in the $n+2^{th}$ frame.

11. The method of claim 10, wherein voltage levels of the first positive gamma voltage, the first negative gamma voltage, the second positive gamma voltage, and the second negative gamma voltage differ according to gradations of input image data.

12. The method of claim 10, wherein the first positive target gamma voltage is determined by adding a compensation voltage determined in advance based on a particular gradation to the positive target gamma voltage, the second positive gamma voltage is determined by subtracting the compensation voltage from the positive target gamma voltage, the first negative gamma voltage is determined by subtracting the compensation voltage to the negative target gamma voltage, and the second negative gamma voltage is determined by adding the compensation voltage to the negative target gamma voltage.

* * * * *